US010418206B2

(12) United States Patent
Niu

(10) Patent No.: US 10,418,206 B2
(45) Date of Patent: Sep. 17, 2019

(54) CONDUCTING STRUCTURE AND CONDUCTING METHOD FOR UPPER SHEET AND LOWER SHEET OF FILM BUTTON CIRCUIT

(71) Applicant: Xiamen Pinnacle Electrical Co., Ltd., Xiamen, Fujian (CN)

(72) Inventor: Leeming Niu, Xiamen (CN)

(73) Assignee: XIAMEN PINNACLE ELECTRICAL CO., LTD., Xiamen, Fujian (CN)

( * ) Notice: Subject to any disclaimer, the term of this patent is extended or adjusted under 35 U.S.C. 154(b) by 77 days.

(21) Appl. No.: 15/871,118

(22) Filed: Jan. 15, 2018

(65) Prior Publication Data

US 2018/0137995 A1 May 17, 2018

Related U.S. Application Data

(62) Division of application No. 15/125,147, filed on Sep. 10, 2016, now abandoned.

(51) Int. Cl.

| | |
|---|---|
| ***H01H 11/04*** | (2006.01) |
| ***H01H 13/704*** | (2006.01) |
| ***H01H 13/78*** | (2006.01) |

(52) U.S. Cl.

CPC ..... *H01H 13/704* (2013.01); *H01H 11/04* (2013.01); *H01H 13/78* (2013.01);

(Continued)

(58) Field of Classification Search

CPC ..... H01H 2229/028; H01H 11/04; H01H 13/704; H01H 13/80; H01H 13/807; H01H 1/0036; H01H 1/021; H01H 1/029; H01H 2001/0042; H01H 2001/0084; H01H 2201/008; H01H 2201/026; H01H 2201/028; H01H 2201/03; H01H 2205/002; H01H 2207/004; H01H 2207/008; H01H 2207/01; H01H 2207/016; H01H 2207/036; H01H 2209/026; H01H 2209/038; H01H 2209/04; H01H 2209/06; H01H 2209/082;

(Continued)

(56) References Cited

U.S. PATENT DOCUMENTS 4,996,511 A * 2/1991 Ohkawa ..... G01L 1/205 338/114
5,948,990 A * 9/1999 Hashida ..... G01L 1/20 338/114

(Continued)

*Primary Examiner* — Ahmed M Saeed
(74) *Attorney, Agent, or Firm* — Leong C. Lei

(57) ABSTRACT

A novel conducting structure and conducting method for an upper sheet and a lower sheet of a film button circuit. A first upper sheet conducting layer and a second upper sheet conducting layer are coated in sequence on an upper sheet conducting contact point. A first lower sheet conducting layer and a second lower sheet conducting layer are coated in sequence on a lower sheet conducting contact point. The first upper sheet conducting layer, the second upper sheet conducting layer, the second lower sheet conducting layer and the first lower sheet conducting layer are overlapped in sequence, thereby forming a composite conducting layer that is slightly greater than a back glue layer in thickness. The present invention can simplify assembly processes and can improve the production efficiency.

4 Claims, 4 Drawing Sheets

(52) U.S. Cl.
CPC . *H01H 2207/004* (2013.01); *H01H 2207/008* (2013.01); *H01H 2207/01* (2013.01); *H01H 2207/036* (2013.01); *H01H 2211/004* (2013.01); *H01H 2229/028* (2013.01)

(58) Field of Classification Search
CPC ..... H01H 2209/084; H01H 2211/004; H01H 2211/006; H01H 2219/03; H01H 2221/004; H01H 2221/016; H01H 2221/05; H01H 2221/064; H01H 2227/002; H01H 2227/012; H01H 2227/014; H01H 2227/018; H01H 2227/036; H01H 2229/002; H01H 2229/012; H01H 2229/058; H01H 2229/062; H01H 2231/012; H01H 2239/018; H01H 2239/078; H01H 59/0009
See application file for complete search history.

(56) References Cited

U.S. PATENT DOCUMENTS

| | | | | |
|---|---|---|---|---|
| 6,555,024 | B2 * | 4/2003 | Ueda | C09D 11/52 252/500 |
| 7,112,755 | B2 * | 9/2006 | Kitano | G01L 1/20 200/17 R |
| 7,348,513 | B2 * | 3/2008 | Lin | H01H 13/703 200/512 |
| 7,528,337 | B2 * | 5/2009 | Tanabe | G01L 1/20 200/511 |
| 8,371,174 | B2 * | 2/2013 | Chen | G01L 9/0052 361/283.4 |
| 2004/0231969 | A1 * | 11/2004 | Kitano | G01L 1/20 200/511 |

* cited by examiner

CONDUCTING STRUCTURE AND CONDUCTING METHOD FOR UPPER SHEET AND LOWER SHEET OF FILM BUTTON CIRCUIT

CROSS-REFERENCE TO RELATED APPLICATION

This is a divisional application of co-pending U.S. patent application Ser. No. 15/125,147 filed on Sep. 10, 2016 and owned by the present applicant.

BACKGROUND OF THE INVENTION

1. Field of the Invention

The present invention relates to a button circuit of an electronic product, and more particularly to a novel conducting structure and a conducting method for an upper sheet and a lower sheet of a film button circuit.

2. Description of the Prior Art

Most conventional film button circuit sheets on the market are composed of an upper circuit sheet and a lower circuit sheet (made of a PET transparent sheet). The lower surface of the upper circuit sheet and the upper surface of the lower circuit sheet are printed with X-Y silver paste matrix circuits and bonded together through a back glue layer. As shown in FIG. 1, tongues 101, 201 extend out from the upper and lower circuit sheets 100, 200 respectively. The upper and lower circuit sheets 100, 200 are provided with conducting contact points on the tongues 101, 201 corresponding to respective buttons. The distal ends of the tongues 101, 201 are connected with piercing conducting terminals 102, 202 by riveting. The piercing conducting terminals 102, 202 are electrically connected with respective pin sockets of a circuit board 300 to form an X-Y matrix button circuit to be scanned and trigged by a microprocessor.

The tongues extend from the upper and lower circuit sheets of the film button circuit sheet for X-Y signal output. The tongues are respectively plugged on two pin sockets through the piercing conducting terminals. This structure has the following drawbacks. The area of the film button circuit sheet is large. The matrix circuit formed by the upper and lower circuit sheets must have a certain length to be plugged on the circuit board, so the cost is high. The tongues must be connected with the piercing pin sockets by riveting for connection of the pin sockets. The processing technique is more complicated and the cost is high. Accordingly, the inventor of the present invention has devoted himself based on his many years of practical experiences to solve this problem.

SUMMARY OF THE INVENTION

The primary object of the present invention is to provide a novel conducting structure and a conducting method for an upper sheet and a lower sheet of a film button circuit. The conducting structure has the advantages of low cost, convenience in machining and high working reliability.

According to an aspect of the present invention, a novel conducting structure for an upper sheet and a lower sheet of a film button circuit is provided. The conducting structure has an upper circuit sheet and a lower circuit sheet. A lower surface of the upper circuit sheet and an upper surface of the lower circuit sheet are bonded together through a back glue layer. The lower surface of the upper circuit sheet is provided with a plurality of upper sheet conducting contact points corresponding to buttons arranged in rows and columns. The upper surface of the lower circuit sheet is provided with a plurality of lower sheet conducting contact points corresponding to the buttons arranged in rows and columns. The respective upper sheet conducting contact points and the respective lower sheet conducting contact points are disposed outside button areas of the upper and lower circuit sheets. The respective upper sheet conducting contact points and the respective lower sheet conducting contact points are disposed correspondingly. Each upper sheet conducting contact point is coated with a first upper sheet conducting layer and a second upper sheet conducting layer in sequence. Each lower sheet conducting contact point is coated with a first lower sheet conducting layer and a second lower sheet conducting layer in sequence. The first upper sheet conducting layer, the second upper sheet conducting layer, the second lower sheet conducting layer and the first lower sheet conducting layer are overlapped in sequence to form a composite conducting layer. The composite conducting layer has a thickness slightly greater than that of the back glue layer to form a conduction pressure between the corresponding upper and lower sheet conducting contact points. The corresponding upper and lower sheet conducting contact points lead X-Y matrix circuits to the upper circuit sheet and the lower circuit sheet to be guided out and plugged on a FPC connector through a flat cable.

Preferably, the thickness of the composite conducting layer is greater than that of the back glue layer by 0.01 mm-0.1 mm.

Preferably, the first upper sheet conducting layer and the first lower sheet conducting layer are conducting silver paste layers, and the second upper sheet conducting layer and the second lower sheet conducting layer are conducting carbon film layers.

Preferably, the second upper sheet conducting layer and the second lower sheet conducting layer completely cover the first upper sheet conducting layer and the first lower sheet conducting layer, respectively.

According to another aspect of the present invention, a novel conducting method for an upper sheet and a lower sheet of a film button circuit is provided. The conducting method comprises the following steps:

S1: preparing an upper circuit sheet and a lower circuit sheet which are printed with predetermined circuits respectively, a lower surface of the upper circuit sheet being provided with a plurality of upper sheet conducting contact points corresponding to buttons arranged in rows and columns, an upper surface of the lower circuit sheet being provided with a plurality of lower sheet conducting contact points corresponding to the buttons arranged in rows and columns, the respective upper sheet conducting contact points and the respective lower sheet conducting contact points being disposed outside button areas of the upper and lower circuit sheets, the respective upper sheet conducting contact points and the respective lower sheet conducting contact points being disposed correspondingly;

S2: each upper sheet conducting contact point being coated with a first upper sheet conducting layer and a second upper sheet conducting layer in sequence, each lower sheet conducting contact point being coated with a first lower sheet conducting layer and a second lower sheet conducting layer in sequence, the first upper sheet conducting layer, the second upper sheet conducting layer, the second lower sheet conducting layer and the first lower sheet conducting layer being overlapped in sequence to form a composite conducting layer;

S3: the lower surface of the upper circuit sheet and the upper surface of the lower circuit sheet after treated by the Step S2 being bounded together through a back glue layer, a thickness of the back glue layer being controlled, enabling the composite conducting layer to have a thickness slightly greater than the thickness of the back glue layer to form a conduction pressure between the corresponding upper and lower sheet conducting contact points; and S4: the corresponding upper conducting contact points and the corresponding lower sheet conducting contact points being conducted to lead X-Y matrix circuits to the upper circuit sheet and the lower circuit sheet to be guided out and plugged on a FPC connector through a flat cable.

Preferably, the thickness of the composite conducting layer is greater than that of the back glue layer by 0.01 mm-0.1 mm.

Preferably, the first upper sheet conducting layer and the first lower sheet conducting layer are conducting silver paste layers, and the second upper sheet conducting layer and the second lower sheet conducting layer are conducting carbon film layers.

Preferably, the second upper sheet conducting layer and the second lower sheet conducting layer completely cover the first upper sheet conducting layer and the first lower sheet conducting layer, respectively.

Accordingly, the features of the novel conducting structure and conducting method for an upper sheet and a lower sheet of a film button circuit of the present invention are that each upper sheet conducting contact point is coated with the first upper sheet conducting layer and the second upper sheet conducting layer in sequence, each lower sheet conducting contact point is coated with the first lower sheet conducting layer and the second lower sheet conducting layer in sequence, the first upper sheet conducting layer, the second upper sheet conducting layer, the second lower sheet conducting layer and the first lower sheet conducting layer are overlapped in sequence to form the composite conducting layer, and the composite conducting layer has a thickness slightly greater than that of the back glue layer. The upper sheet conducting contact points and the lower sheet conducting contact points are cushioned and raised by using a low-cost multiple-time printing way, and the second upper sheet conducting layer and the second lower sheet conducting layer are reliably compressed together by using micro deformation force generated as the composite conducting layer is slightly greater than the back glue layer in thickness, thereby realizing the conduction of buttons. Through this structure, a bar-shaped conducting pressure is formed between the upper and lower sheet conducting contact points. The conducting structure has the advantages of low cost, convenience in machining and high working reliability. The method can simplify production testing and assembly processes, and can improve the production efficiency.

DETAILED DESCRIPTION OF THE PREFERRED EMBODIMENTS

Embodiments of the present invention will now be described, by way of example only, with reference to the accompanying drawings.

Figure 1:
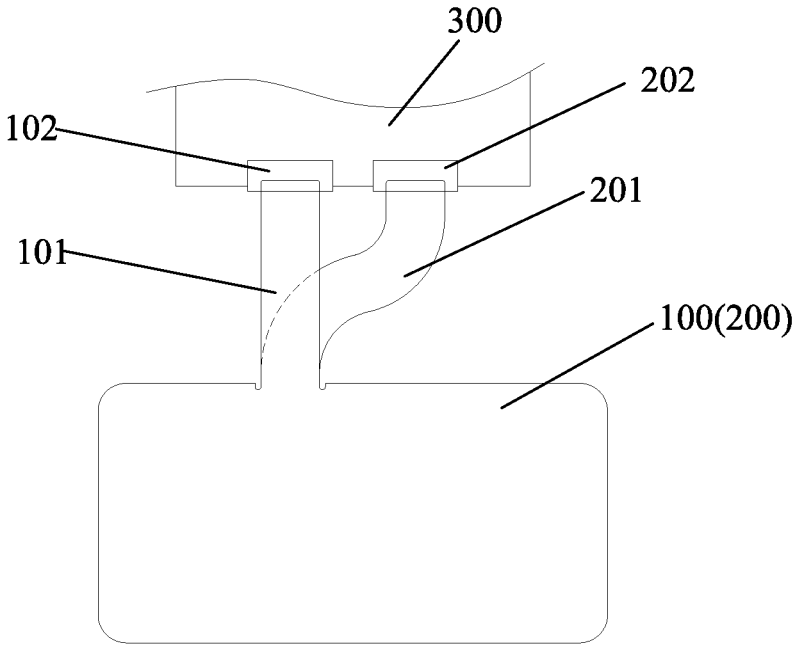
FIG. 1 is a schematic view of a novel conducting structure for an upper sheet and a lower sheet of a film button circuit of the prior art.
Figure 2:
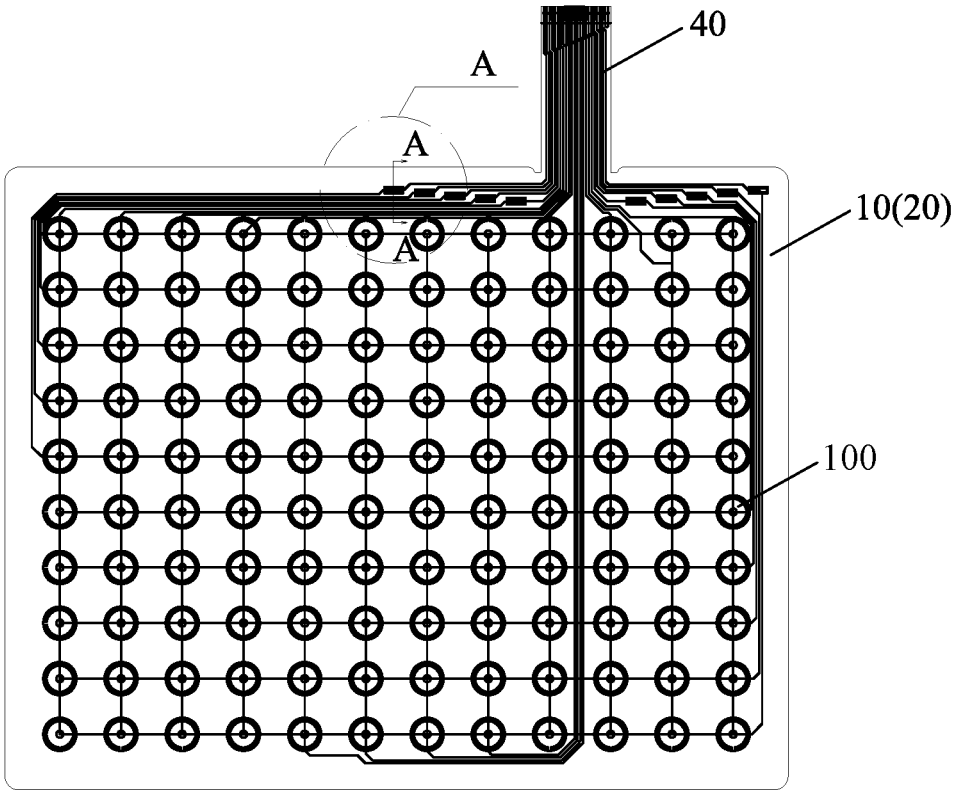
FIG. 2 is a schematic view of a novel conducting structure for an upper sheet and a lower sheet of a film button circuit of the present invention.
Figure 3:
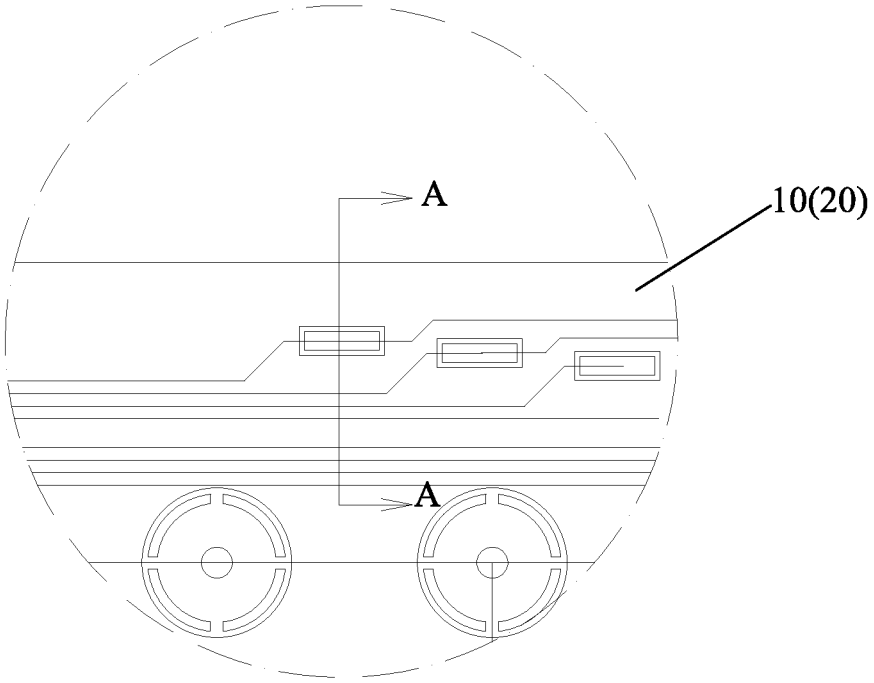
FIG. 3 is a partial enlarged view of FIG. 2.
Figure 4:
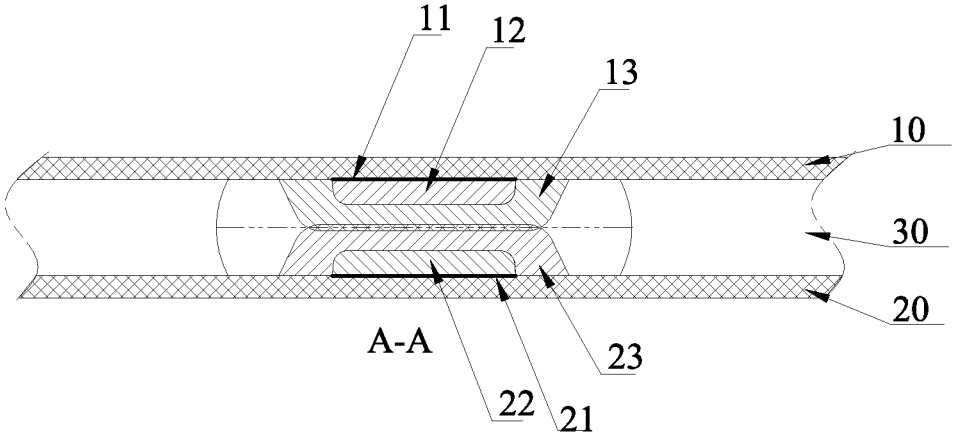
FIG. 4 is a sectional view taken along line A-A of FIG. 3.

As shown in FIG. 2 to FIG. 4, a novel conducting structure for an upper sheet and a lower sheet of a film button circuit of the present invention comprises an upper circuit sheet 10 and a lower circuit sheet 20. A lower surface of the upper circuit sheet 10 and an upper surface of the lower circuit sheet 20 are bonded together through a back glue layer 30.

The lower surface of the upper circuit sheet 10 is provided with a plurality of upper sheet conducting contact points 11 corresponding to buttons arranged in rows and columns. The upper surface of the lower circuit sheet 20 is provided with a plurality of lower sheet conducting contact points 21 corresponding to the buttons 100 arranged in rows and columns (see FIG. 2). The respective upper sheet conducting contact points 11 and the respective lower sheet conducting contact points 21 are disposed outside button areas of the upper and lower circuit sheets. The respective upper sheet conducting contact points 11 and the respective lower sheet conducting contact points 21 are disposed correspondingly.

Each upper sheet conducting contact point 11 is coated with a first upper sheet conducting layer 12 and a second upper sheet conducting layer 13 in sequence. Each lower sheet conducting contact point 21 is coated with a first lower sheet conducting layer 22 and a second lower sheet conducting layer 23 in sequence. The first upper sheet conducting layer 12, the second upper sheet conducting layer 13, the second lower sheet conducting layer 23 and the first lower sheet conducting layer 22 are overlapped in sequence to form a composite conducting layer. The composite conducting layer has a thickness slightly greater than that of the back glue layer 30. In this embodiment, the thickness of the composite conducting layer is greater than that of the back glue layer 30 by 0.01 mm-0.1 mm.

The corresponding upper sheet conducting contact points 11 and the corresponding lower sheet conducting contact points 21 are conducted to lead X-Y matrix circuits to the upper circuit sheet 10 and the lower circuit sheet 20 to be guided out and plugged on a FPC connector through a flat cable 40.

A novel conducting method for an upper sheet and a lower sheet of a film button circuit of the present invention comprises the following steps:

S1: preparing an upper circuit sheet 10 and a lower circuit sheet 20 which are printed with predetermined circuits respectively, in this embodiment, a lower surface of the upper circuit sheet and an upper surface of the lower circuit sheet are printed with X-Y silver paste matrix circuits respectively, the lower surface of the upper circuit sheet 10 is provided with a plurality of upper sheet conducting contact points 11 corresponding to buttons arranged in rows and columns, the upper surface of the lower circuit sheet 20 is provided with a plurality of lower sheet conducting contact points 21 corresponding to the buttons arranged in rows and columns, the respective upper sheet conducting contact points 11 and the lower sheet conducting contact points 21 are disposed outside button areas of the upper and lower circuit sheets, the respective upper sheet conducting contact points 11 and the respective lower sheet conducting contact points 21 are disposed correspondingly;

S2: each upper sheet conducting contact point 11 is coated with a first upper sheet conducting layer 12 and a second upper sheet conducting layer 13 in sequence, each lower sheet conducting contact point 21 is coated with a first lower sheet conducting layer 22 and a second lower sheet conducting layer 23 in sequence, the first upper sheet conducting layer 12, the second upper sheet conducting layer 13, the second lower sheet conducting layer 23 and the first lower sheet conducting layer 22 are overlapped in sequence to form a composite conducting layer;

S3: the lower surface of the upper circuit sheet 10 and the upper surface of the lower circuit sheet 20 after treated by the Step S2 are bounded together through a back glue layer 30, the thickness of the back glue layer is controlled, enabling the composite conducting layer to have a thickness slightly greater than that of the back glue layer 30, in this embodiment, the thickness of the composite conducting layer is greater than that of the back glue layer 30 by 0.01 mm-0.1 mm to form a conduction pressure between the corresponding upper and lower sheet conducting contact points;

S4: the corresponding upper sheet conducting contact points 11 and the corresponding lower sheet conducting contact points 21 are conducted to lead X-Y matrix circuits to the upper circuit sheet 10 and the lower circuit sheet 20 to be guided out and plugged on a FPC connector through a flat cable 40.

In this embodiment, the first upper sheet conducting layer and the first lower sheet conducting layer are conducting silver paste layers. The second upper sheet conducting layer and the second lower sheet conducting layer are conducting carbon film layers. The second upper sheet conducting layer and the second lower sheet conducting layer completely cover the first upper sheet conducting layer and the first lower sheet conducting layer, respectively.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A novel conducting method for an upper sheet and a lower sheet of a film button circuit, comprising the following steps:

S1: preparing an upper circuit sheet and a lower circuit sheet which are printed with predetermined circuits respectively, a lower surface of the upper circuit sheet being provided with a plurality of upper sheet conducting contact points corresponding to buttons arranged in rows and columns, an upper surface of the lower circuit sheet being provided with a plurality of lower sheet conducting contact points corresponding to the buttons arranged in rows and columns, the respective upper sheet conducting contact points and the respective lower sheet conducting contact points being disposed outside button areas of the upper and lower circuit sheets, the respective upper sheet conducting contact points and the respective lower sheet conducting contact points being disposed correspondingly;

S2: each upper sheet conducting contact point being coated with a first upper sheet conducting layer and a second upper sheet conducting layer in sequence, each lower sheet conducting contact point being coated with a first lower sheet conducting layer and a second lower sheet conducting layer in sequence, the first upper sheet conducting layer, the second upper sheet conducting layer, the second lower sheet conducting layer and the first lower sheet conducting layer being overlapped in sequence to form a composite conducting layer;

S3: the lower surface of the upper circuit sheet and the upper surface of the lower circuit sheet after treated by the Step S2 being bounded together through a back glue layer, a thickness of the back glue layer being controlled, enabling the composite conducting layer to have a thickness slightly greater than the thickness of the back glue layer to form a conduction pressure between the corresponding upper and lower sheet conducting contact points; and S4: the corresponding upper conducting contact points and the corresponding lower sheet conducting contact points being conducted to lead X-Y matrix circuits to the upper circuit sheet and the lower circuit sheet to be guided out and plugged on a FPC connector through a flat cable.

2. The novel conducting method for the upper sheet and the lower sheet of the film button circuit as claimed in claim 1, wherein the thickness of the composite conducting layer is greater than that of the back glue layer by 0.01 mm-0.1 mm.

3. The novel conducting method for the upper sheet and the lower sheet of the film button circuit as claimed in claim 1, wherein the first upper sheet conducting layer and the first lower sheet conducting layer are conducting silver paste layers, and the second upper sheet conducting layer and the second lower sheet conducting layer are conducting carbon film layers.

4. The novel conducting method for the upper sheet and the lower sheet of the film button circuit as claimed in claim 1, wherein the second upper sheet conducting layer and the second lower sheet conducting layer completely cover the first upper sheet conducting layer and the first lower sheet conducting layer, respectively.

* * * * *